US005994039A

United States Patent [19]

Fitterman et al.

[11] Patent Number: 5,994,039

[45] Date of Patent: Nov. 30, 1999

[54] BLACK-AND-WHITE PHOTOGRAPHIC DEVELOPING COMPOSITION AND A METHOD FOR ITS USE

[75] Inventors: Alan S. Fitterman; Shirleyanne E. Haye, both of Rochester; Janet M. Huston, Webster; Joan F. Rachel, Penfield, all of N.Y.

[73] Assignee: Eastman Kodak Company, Rochester, N.Y.

[21] Appl. No.: 09/138,485

[22] Filed: Aug. 24, 1998

[51] Int. Cl.[6] ..... G03C 5/29

[52] U.S. Cl. ..... 430/434; 430/486; 430/490; 430/492; 430/497

[58] Field of Search ..... 430/434

[56] References Cited

U.S. PATENT DOCUMENTS

| | | | |
|---|---|---|---|
| 3,630,744 | 12/1971 | Thiers et al. | 430/606 |
| 4,269,929 | 5/1981 | Nothnagle | 430/264 |
| 4,391,900 | 7/1983 | Toyoda et al. | 430/355 |
| 4,672,025 | 6/1987 | Yamada et al. | 430/420 |
| 4,810,622 | 3/1989 | Yamada et al. | 430/420 |
| 4,965,169 | 10/1990 | Hirano et al. | 430/264 |
| 5,041,363 | 8/1991 | Sakuma | 430/435 |
| 5,187,050 | 2/1993 | Yamada et al. | 430/399 |
| 5,210,010 | 5/1993 | Fielding | 430/466 |
| 5,389,502 | 2/1995 | Fitterman et al. | 430/491 |
| 5,576,156 | 11/1996 | Dickerson | 430/496 |
| 5,702,875 | 12/1997 | Opitz et al. | 430/429 |
| 5,866,309 | 2/1999 | Fitterman et al. | 430/440 |

*Primary Examiner*—Hoa Van Le
*Attorney, Agent, or Firm*—J. Lanny Tucker

[57] ABSTRACT

Black-and-white elements, such as radiographic films, can be processed rapidly using a black-and-white developing composition containing a hydroquinone developing agent, and specific amounts of sulfite and borate ions. Thus, the molar ratio of sulfite ions to borate ions is less than 20:1, and the molar ratio of sulfite ions to the hydroquinone developing agent is from about 1:1 to about 2.5:1. The developing composition is effective, rapid and stable.

19 Claims, 1 Drawing Sheet

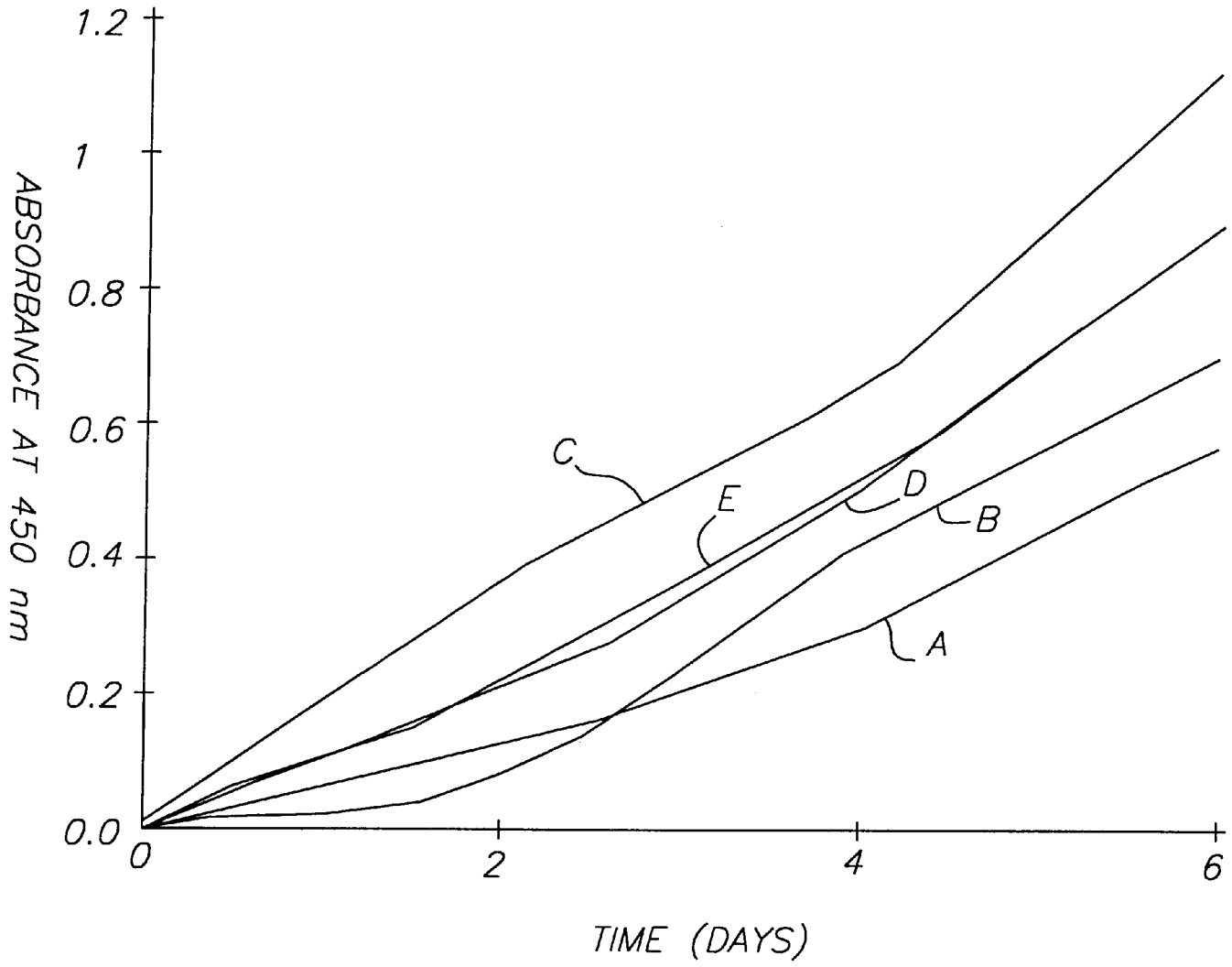
ABSORBANCE AT 450 nm
1.2
1
0.8
0.6
0.4
0.2
0.0
0
2
4
6
TIME (DAYS)
A
B
C
D
E

BLACK-AND-WHITE PHOTOGRAPHIC DEVELOPING COMPOSITION AND A METHOD FOR ITS USE

COPENDING APPLICATIONS

Copending and commonly assigned U.S. Ser. No. 08/956,305, filed Oct. 22, 1997 by Fitterman et al.

Copending and commonly assigned U.S. Ser. No. 08/970,869, filed Nov. 14, 1997, by Fitterman et al.

Copending and commonly assigned U.S. Ser. No. 09/046,447 filed Mar. 23, 1998 by Fitterman et al.

Copending and commonly assigned U.S. Ser. No. 09/046,449 filed Mar. 23, 1998 by Dickerson et al.

Copending and commonly assigned U.S. Ser. No. 09/080,732 filed May 18, 1998 by Fitterman et al.

Copending and commonly assigned U.S. Ser. No. 09/080,792 filed May 18, 1998 by Fitterman et al.

Copending and commonly assigned U.S. Ser. No. 09/092,066 filed Jun. 5, 1998 by Fitterman et al.

FIELD OF THE INVENTION

This invention relates in general to photography and in particular to an improved black-and-white photographic developing composition. It also relates to a method of using this developing composition to process black-and-white photographic silver halide elements.

BACKGROUND OF THE INVENTION

Roentgen discovered X-radiation by the inadvertent exposure of a silver halide photographic element. In 1913, Eastman Kodak Company introduced its first product specifically intended to be exposed by X-radiation (X-rays). Silver halide radiographic films account for the overwhelming majority of medical diagnostic images. It was recognized almost immediately that the high energy ionizing X-rays are potentially harmful, and ways were sought to avoid high levels of patient exposure. Radiographic films provide viewable silver images upon imagewise exposure followed by rapid access processing.

One approach still in use is to coat the silver halide emulsions useful in radiographic films on both sides of the film support. Thus, the number of X-rays that can be absorbed and used for imaging are doubled, providing higher sensitivity. Dual-coated radiographic films are sold by Eastman Kodak Company as DUPLITIZED™ films. Films that rely entirely upon X-radiation absorption for image capture are referred to in the art as "direct" radiographic films while those that rely on intensifying screen light emission are referred to as "indirect" radiographic films. Because the silver halide emulsions in direct radiographic elements are used to capture the X-rays directly, the silver coating coverages are generally higher than for indirect radiographic elements.

Among the "direct" radiographic films, are films most commonly used for dental intra-oral diagnostic imaging and hereafter referred to as dental films. Intra-oral dental imaging presents obvious barriers to the use of intensifying screens. There are other applications for direct radiographic films, such as in various industrial applications where X-rays are captured in imaging, but intensifying screens cannot be used for some reason.

It is the prevailing practice to process direct radiographic films for more than 3 minutes because of higher silver coverage. Such processes typically include black-and-white development, fixing, washing and drying. Films processed in this manner are then ready for viewing.

Photographic developing solutions containing a silver halide developing agent are well known in the photographic art for reducing silver halide grains containing a latent image to yield a developed photographic image. Many useful developing agents are known in the art, with hydroquinone and similar dihydroxybenzene compounds and ascorbic acid (and derivatives) being some of the most common. Such solutions generally contain other components such as sulfites as antioxidants, buffers, antifoggants, halides and hardeners. A workable pH for such solutions is usually in the range of from about 10 to about 11, depending upon the developing agent and other solution components.

Fixing solutions for radiographic films are also well known and include one or more fixing agents, of which thiosulfates are most common. Such solutions also generally include sulfites as antioxidants, and hardeners (such as aluminum salts), and a buffer (such as acetate), and have a functional pH range of from about 4 to about 5.5.

Sulfite ion has long been known as a preservative in photographic developing compositions. Thus, it has become a universal preservative for black-and-white developing agents by stabilizing and maintaining uniform activity. In addition, high concentrations of sulfite ions are known to provide considerable protection from aerial oxidation by reducing the solubility of oxygen in the developing composition. High molar ratios of sulfite ion to hydroquinone type developing agents are common in black-and-white developing compositions (see for example, TABLE V below). However, high sulfite levels are often undesirable because sulfite ion can act as a weak silver complexing agent. In addition, U.S. Pat. No. 4,672,025 (Yamada et al) suggests molar ratios of 1.6:1 to 3.5:1 with molar ratios of from 1.65:1 to 2.8:1 being preferred.

Borates are known as buffering agents in black-and-white developing compositions (see for example U.S. Pat. No. 4,810,622 of Yamada et al and U.S. Pat. No. 5,702,875 of Opitz et al), but borate ions typically have limited solubility, so they are often used in combination with other buffering agents. They also limit solution alkalinity so that higher pH is difficult to maintain using borates alone.

In high activity developing compositions used for rapid processing, the level of hydroquinone developing agent is quite high. However, this limits the molar ratio of sulfite to hydroquinone, without which in time, stability problems are encountered due to aerial oxidation and hydroquinone degradation. Increasing the sulfite level alone at this point is ineffective. Moreover, as hydroquinone activity is lost, the activity from co-developers such as 3-pyrazolidone co-developers is also prematurely diminished.

This is a need for a black-and-white developing composition that can include high hydroquinone developing agent concentration, but also have the desired stability without the need for high chemical loading with sulfites.

SUMMARY OF THE INVENTION

The present invention provides an advance in the art over known processing compositions and methods with a black-and-white developing composition comprising:

- at least 0.05 mol/l of a black-and-white hydroquinone developing agent,
- at least 0.05 mol/l of sulfite ions, and
- at least 0.004 mol/l of a borate buffering agent,
- wherein the molar ratio of sulfite ions to borate ions is less than 20:1, and the molar ratio of sulfite ions to the hydroquinone developing agent is from about 1:1 to about 2.5:1.

This invention also provides a method for providing a black-and-white image comprising:

A) processing an imagewise exposed black-and-white photographic silver halide element with a black-and-white developing composition having a pH of from about 9 to about 12.5, and having the components described above, and B) at least one additional photographic processing step, the element comprising a support having thereon one or more layers, at least one of the layers being a silver halide emulsion layer.

In preferred embodiments, the element further comprises:

in one of the layers, a microcrystalline particulate dye that absorbs electromagnetic radiation in the visible and UV portions of the spectrum and is decolorized during fixing, and in each silver halide emulsion layer, a desensitizer that reduces sensitivity of the silver halide emulsion layer to electromagnetic radiation in the visible portion of the spectrum by trapping electrons generated by exposure to that electromagnetic radiation.

Further, this invention provides a processing kit useful for carrying out the described processing method. This kit includes the black-and-white developing composition described above, and any one of the following components:

a photographic fixing composition, a black-and-white photographic silver halide element as described herein, or a processing container.

The present invention provides an improved black-and-white developing composition that can accommodate higher concentrations of hydroquinone developing agents, but without loss of stability (for example as observed from discoloration). The developing composition is effective in rapid processing, costs less and requires less chemical loading with sulfites. These advantages were obtained by using a critical combination of borate and sulfite ions to achieve the desired stability, preservation and buffering simultaneously. The composition is particularly useful for rapid processing of "direct" radiographic films, such as dental and various industrial films having generally higher silver coating coverage. Additional details about the advantages and effects of the invention are provided in Examples 1–3 below.

BRIEF DESCRIPTION OF THE DRAWING

FIG. 1 is a graphical plot of discoloration data obtained for several black-and-white developing compositions as described in Example 3 below.

DETAILED DESCRIPTION OF THE INVENTION

The present invention is useful for providing a black-and-white image in a photographic silver halide element, and preferably a radiographic film (such as a dental film). Other types of elements that can be processed using the present invention include, but are not limited to, aerial films, black-and-white motion picture films, duplicating and copy films, and amateur and professional continuous tone black-and-white films. The composition of such materials is well known in the art. It is particularly desirable to process photographic silver halide elements that have relatively high silver coverage using the present invention. Such elements generally have at least 5 g/m$^2$ of silver (in the form of silver halides), and preferably from about 7.5 to about 25 g/m$^2$ of silver.

The black-and-white developing composition useful in the practice of this invention contains one or more black-and-white dihydroxybenzene developing agents, including dihydroxybenzene and derivatives thereof. Dihydroxybenzene and similar developing agents include hydroquinone and other derivatives readily apparent to those skilled in the art (see for example, U.S. Pat. No. 4,269,929 of Nothnagle and U.S. Pat. No. 5,457,011 of Lehr et al, both incorporated herein by reference). Representative compounds include, but are not limited to, hydroquinone, chlorohydroquinone, bromohydroquinone, isopropylhydroquinone, methylhydroquinone, toluhydroquinone, 2,3-dichlorohydroquinone, 2,5-dimethylhydroquinone, 1,4-dihydroxy-2-acetophenone-2,5-dimethylhydroquinone, 2,5-di-p-phenenthylhydroquinone, 2,5-dibenzoylhydroquinone and 2,5-diacetaminohydroquinone. Hydroquinone is preferred.

The developing composition also includes one or more sulfite preservatives or antioxidants. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used. Examples of preferred sulfites include sodium sulfite, potassium sulfite, lithium sulfite, sodium bisulfite, potassium bisulfite, sodium metabisulfite, potassium metabisulfite and lithium metabisulfite. Useful carbonyl-bisulfite adducts include alkali metal or amine bisulfite adducts of aldehydes and bisulfite adducts of ketones, such as sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Borate ions are also present in the developing composition of this invention. They can be provided as boric acid, sodium metaborate, potassium metaborate, sodium tetraborate, potassium tetraborate, and other borates that would be readily apparent to one skilled in the art.

The developing composition of this invention optionally but preferably includes one or more auxiliary co-developing agents, that are also well known (e.g., Mason, *Photographic Processing Chemistry,* Focal Press, London, 1975). Any auxiliary co-developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl-4,4-dihydroxymethyl-3-pyrazolidone. Other useful co-developing agents comprise one or more solubilizing groups, such as sulfo, carboxy or hydroxy groups attached to aliphatic chains or aromatic rings, and preferably attached to the hydroxymethyl function of a pyrazolidone. A most preferred co-developing agent is 4-hydroxymethyl-4-methyl-1-phenyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol.

A mixture of different types of auxiliary developing agents can also be used if desired.

An organic antifoggant is also preferably in the developing composition, either singly or in admixture. Such compounds control the gross fog appearance in the processed elements. Suitable antifoggants include, but are not limited to, benzimidazoles, benzotriazoles, mercaptotetrazoles, indazoles and mercaptothiadiazoles. Representative antifoggants include 5-nitroindazole, 5-p-nitrobenzoylaminoimidazole, 1-methyl-5-nitroindazole, 6-nitroindazole, 3-methyl- 5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole. Benzotriazole is most preferred.

In addition to a borate, the composition can include other known buffers, such as carbonates and phosphates to maintain the desired pH to from about 9 to about 12.5, when the composition is in aqueous form. The pH of the aqueous developing composition is preferably from about 10 to about 12, and more preferably from about 10.5 to about 11.5.

As described in U.S. Ser. No. 09/046,447 (noted above), the developing composition can also include one or more particulate opacifying agents that are dispersible therein, and that will absorb essentially all radiation in the UV and visible portions of the electromagnetic spectrum. Carbon black is a preferred opacifying agent, but other pigments and dyes may be also useful for this purpose. Such developing compositions have the advantage that they can be used to process photographic elements in roomlight.

Alternatively, as described in U.S. Ser. No. 09/080,792 (noted above), the developing composition can include one or more water-soluble colorants that have a maximum absorption wavelength ($\lambda$max) in the range of from about 350 to about 500 nm, and preferably from about 390 to about 490 nm. The developing composition containing the colorants is generally transparent because the colorants are transparent in solution. These colorants also enable use of the developing composition in roomlight.

The useful colorants can be chosen from a wide variety of water-soluble dyes (most of which are "yellow" dyes), including such well known classes as anionic monoazo dyes, anionic diazo dyes, naphthalene sulfonic acid dyes, and water-soluble styryl dyes. The anionic monazo dyes are preferred. Representative examples of such colorants include, but are not limited to, conventional food coloring dyes, Tartrazine (Acid Yellow 23), Naphthol Yellow S (Acid Yellow 1), Pinacryptol Yellow, Mordant Orange 6 (Chrome Orange GR), Mordant Brown 33 (Acid Anthracene Brown RH), Mordant Yellow 12, Thiazol Yellow G (Direct Yellow 9), and Fast Yellow (Acid Yellow 9). Mixtures of colorants can be used if desired, including mixtures of "yellow" dyes, and mixtures of "yellow" dyes and other dyes (such as blue dyes) as long as the "yellow" dye(s) provide the desired light protection.

The particulate opacifying agent or water-soluble colorant described above can be present in the developing composition at generally at least 1 weight %, and generally less than 5, and preferably less than 3 weight %, based on total composition weight.

It is optional for the developing composition of this invention to also contain one or more sequestering agents that typically function to form stable complexes with free metal ions (such as silver ions) in solution, in conventional amounts. Many useful sequestering agents are known in the art, but particularly useful classes of compounds include, but are not limited to, multimeric carboxylic acids as described in U.S. Pat. No. 5,389,502 (Fitterman et al), aminopolycarboxylic acids, polyphosphate ligands, ketocarboxylic acids, and alkanolamines. Representative sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid and ethylenediaminomonosuccinic acid.

The developing composition can also contain other additives including various development restrainers, development accelerators, swelling control agents and stabilizing agents, each in conventional amounts. Examples of such optional components are described in U.S. Pat. No. 5,236,816 (noted above), U.S. Pat. No. 5,474,879 (Fitterman et al), Japanese Kokai 7-56286 and EP-A-0 585 792.

The essential and some optional components described above are present in the aqueous developing composition in the general and preferred amounts listed in Table I below, all amounts being approximate (that is, "about"). If formulated in dry form, the developing composition would have the essential components in amounts readily apparent to one skilled in the art suitable to provide the desired aqueous concentrations.

TABLE I

| Developing Composition | General Amount | Preferred Amount |
|---|---|---|
| Hydroquinone developing agent | 0.1 to 0.5 mol/l | 0.15 to 0.4 mol/l |
| Co-developing agent | 3 to 150 mmol/l | 4 to 50 mmol/l |
| Antifoggant | 0.01 to 10 mmol/l | 0.1 to 2 mmol/l |
| Sulfite ions | 0.05 to 3 mol/l | 0.2 to 1.25 mol/l |
| Borate ions | 0.01 to 1 mol/l | 0.017 to 0.06 mol/l |
| Molar ratio of sulfite ions to borate ions | less than 20:1 | 10:1–15:1 |
| Molar ratio of sulfite ions to developing agent | 1:1 to 2.5:1 | 1.6:1 to 2:1 |

Following black-and-white development, the photographic element is subjected to one or more additional photographic processing steps, such as fixing and washing. Preferably, at least a fixing step is used.

While sulfite ion sometimes acts as a fixing agent, the fixing agents used in a fixing composition are preferably not sulfites (although sulfites can also be present). Preferably, the fixing agents are chosen from thiosulfates (including sodium thiosulfate, ammonium thiosulfate, potassium thiosulfate and others readily known in the art), mercapto-substituted compounds (such as those described by Haist, *Modern Photographic Processing,* John Wiley & Sons, N.Y., 1979), thiocyanates (such as sodium thiocyanate, potassium thiocyanate, ammonium thiocyanate and others readily known in the art), amines and halides. Mixtures of one or more of these classes of fixing agents can be used if desired. Thiosulfates and thiocyanates are preferred. In a more preferred embodiment, a mixture of a thiocyanate (such as sodium thiocyanate) and a thiosulfate (such as sodium thiosulfate) is used. The sodium salts of the fixing agents are preferred for environmental advantages.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 6, preferably at least 9, and generally less than 11, and preferably less than 12.5.

The fixing agent(s) in the fixing composition are generally present in an amount of at least 1.5 and preferably at least 2 mol/l, and generally up to 6 and preferably up to 5 mol/l. The other components of the fixing composition can be present in conventional amounts.

The developing and fixing compositions useful in this invention are prepared by dissolving or dispersing the components in water and adjusting the pH to the desired value using acids or buffers. The compositions can also be provided in concentrated form, and diluted to working strength before or during use. The compositions can be used as their own replenishers, or similar compositions can be used as the replenishers.

Processing can be carried out in any suitable processor or processing container for a given type of photographic element. For example, for radiographic films, the method can be carried out using the processor described in U.S. Pat. No. 3,545,971 (Barnes et al). One suitable processor is sold by Eastman Kodak Company under the trademark X-OMAT. Dental films can be processed in equipment that is conventional for that purpose. In some embodiments of this invention wherein the developing composition includes either an opacifying agent or colorant, development can be carried out in a container or vessel that can be open to roomlight. In other words, the processing container or processor need not be light-tight.

In most instances, the processed element is a film sheet. Each element is bathed in the processing compositions for a suitable period of time during each stage.

Development and fixing are preferably, but not essentially, followed by a suitable acidic washing step to stop development, to remove silver salts dissolved by fixing and excess fixing agents, and to reduce swelling in the element. The wash solution can be water, but preferably it is acidic, that is the pH is from about 4.5 to about 7, as provided by a suitable chemical acid or buffer.

After washing, the processed elements may be dried for suitable times and temperatures, but in some instances the black-and-white image may be viewed in a wet condition.

Processing times and conditions for the invention are listed in the following Table II. The total time for development and fixing can be as low as 35 seconds, and preferably as low as 50 seconds, and as high as 90 seconds, and preferably, as high as 60 seconds.

TABLE II

| PROCESSING STEP | TEMPERATURE (° C.) | TIME (sec) |
|---|---|---|
| Development | 15–30 | 5–20 |
| Fixing | 15–30 | 10–40 |
| Washing | 15–60 | 5–60 |

The elements processed using the present invention are generally composed of a conventional flexible, transparent film support (polyester, cellulose acetate or polycarbonate) that has applied to one or both sides one or more photographic silver halide emulsion layers. For radiographic films, it is conventional to use blue-tinted support materials to contribute to the blue-black image tone sought in fully processed films. Polyethylene terephthalate and polyethylene naphthalate are preferred film supports.

In general, such elements, emulsions, and layer compositions are described in many publications, including *Research Disclosure,* publication 36544, September 1994. *Research Disclosure* is a publication of Kenneth Mason Publications, Ltd., Dudley House, 12 North Street, Emsworth, Hampshire PO10 7DQ England.

Preferred silver halide emulsions include silver bromide and silver bromoiodide (having up to 15 mol % iodide based on total silver). Preferred silver halide emulsions include forehardened tabular grain emulsions as described, for example, in U.S. Pat. No. 4,414,304 (Dickerson et al), that is emulsions having at least 50% tabular grains having an aspect ratio of at least 2. These emulsions typically have thin tabular grains of predominantly silver bromide and up to 15 mol % iodide based on total silver, an average thickness of less than about 0.3 $\mu$m, and preferably, up to 3 mol % iodide based on total silver and less than about 0.2 $\mu$m. The grains are usually dispersed in forehardened colloids, such as forehardened gelatin (using a conventional hardener). The emulsions also contain conventional addenda for providing desired coating and sensitometric properties, including but not limited to, sensitizing dyes, infrared opacifying dyes, stabilizers, antifoggants, antikinking agents, surfactants, latent-image stabilizers and other materials known in the art.

In some embodiments, the radiographic films processed according to this invention can also include a thiaalkylene bis(quaternary ammonium) salt in at least one layer, to increase imaging speed by acting as development accelerators. Such elements are described in more detail in U.S. Pat. No. 5,652,086 (Brayer et al).

The silver halide emulsion and other layers in the elements contain conventional hydrophilic colloid vehicles (with or without peptizers or other binders), typically gelatin or gelatin derivatives. Various synthetic polymer peptizers or binders can also be used alone or in combination with gelatin or gelatin derivatives.

If the element has one or more silver halide emulsion layers on each side of the support, generally the layers on each side have the same silver halide compositions. In a preferred embodiment, the radiographic films have two silver halide emulsion layers on both sides of the support, with the layers closest the support containing solely silver bromide grains. The silver coverages on each or both sides of the support can be the same or different. Generally, the total silver coverage on each side is at least about 2.5 g $Ag/m^2$, and preferably at least about 3.75 g $Ag/m^2$.

Each side of the element can also include a protective overcoat, or only one side can have an overcoat layer, such a layer containing a hydrophilic colloid material and optionally any other addenda commonly (such as matting agents) used to modify the surface characteristics. The coating coverage of such layers is generally at 0.6 $g/m^2$ of protective colloid, such as a gelatin. Conventional subbing layers can also be included to adhere the silver halide emulsion layers to the support. Other layers, such as interlayers, may be present in the element for conventional purposes, such as providing adhesion. Preferred elements contain an overcoat layer on at least one side of the support.

The total dry thickness of the coated layers on either or both sides of the elements can be at least 3 $\mu$m, and preferably at least 4 $\mu$m. The thickness is generally less than 7 $\mu$m, and preferably less than 6 $\mu$m.

As noted above, in some elements processed using this invention contain one or more particulate dyes and/or one or more desensitizers to provide roomlight handleability. Such materials are thus useful if they absorb all incident electromagnetic radiation at from about 350 to about 550 nm.

Advantageously, the elements contain one or more particulate dyes described above that absorb electromagnetic radiation in the visible and UV regions of the spectrum. These dyes are usually placed in the overcoat layer(s), but they can be in more than one location as long as they are readily decomposed during fixing.

Such particulate dyes generally have a size to facilitate coating and rapid decolorization during processing. In general, the smaller particles are best for these purposes, that is those having a mean diameter of less than 10 μm, and preferably less than 1 μm. The particulate dyes are most conveniently formed by crystallization from solution in sizes ranging down to 0.01 μm or less. Conventional techniques can be used to prepare dyes of the desired size, including ball milling, roller milling and sand milling.

An important criterion is that such dyes remain in particulate form in hydrophilic colloid layers of photographic elements. Various hydrophilic colloids can be used, as would be appreciated by a skilled worker in the art, including those mentioned herein for various layers. Where the particulate dyes are placed in overcoat layers, the particulate dyes are generally the only component besides the binder material.

Classes of useful particulate dyes include, but are not limited to, nonionic classes of compounds such as nonionic polymethine dyes, which include the merocyanine, oxonol, hemioxonol, styryl and arylidene dyes. Anionic dyes of the cyanine class may also be useful as long as they have the desired coatability properties (soluble at pH 5 to 6 and 40° C.) and remain in particulate form after coating. Some useful particulate dyes are described, for example, in U.S. Pat. No. 4,803,150 (Dickerson et al), incorporated herein by reference.

The useful amount of particulate dye in the elements is at least 0.5 g/m$^2$ on each side of the support, and preferably at least 0.7 g/m$^2$. Generally, the upper limit of such materials is 2 g/m$^2$, and preferably, less than 1.5 g/m$^2$ is used. Mixtures of particulate dyes can be used in one or more layers of the element.

The elements can also include one or more "desensitizers" in a silver halide emulsion layer(s) in order to provide additional visible and UV light protection. Conventional desensitizers can be used, as are known in photography and radiography. Various desensitizers are described, for example, in *Research Disclosure,* Vol. 308, December 1989, publication 308119, Section III, the disclosure of which is incorporated herein by reference. Classes of such compounds include azomethine dyes (such as those described in U.S. Pat. No. 3,630,744 of Thiers et al).

Generally, the amount of desensitizer relative to the amount of silver halide in the element is adapted according to the particular silver halide emulsion used in the element, the particular desensitizer used, the ratio of gelatin or other colloid binder to silver halide, other components of the emulsions, and the procedure for preparing the emulsions. All of these factors would be well known to one skilled as a maker of silver halide emulsions. Thus, the amount should be effective to provide for a reduction in visible and UV light sensitivity, but no reduction in sensitivity to X-radiation.

More particularly, the useful amount of desensitizer in the elements is at least 1.5 mg/m$^2$ on each side of the support, and preferably at least 1.7 mg/m$^2$. Generally, the upper limit of such materials is 4 mg/m$^2$, and preferably, less than 3 mg/m$^2$ is used. Mixtures of desensitizers can be used in one or more layers of the element.

The processing method of this invention can be carried out using a processing kit that includes some or all of the components necessary for using the method. Minimally, the processing kit would include the black-and-white developing composition described herein, packaged in a suitable manner. In addition, the kit would include any one or more of the other necessary components, such as the fixing composition described herein, acidic wash described herein, one or more samples of a photographic element described herein, a suitable processing container, instructions for use, fluid or composition metering devices, or any other conventional components of a photographic processing kit. All of the components can be suitably packaged in dry or liquid form in glass or plastic bottles, fluid-impermeable packets or vials. For use to process dental films, the kit would typically include one or more ready-to-use dental film samples or packets.

The following examples are provided for illustrative purposes, and not to be limiting in any manner.

Materials and Methods for Examples

A radiographic film was prepared having the following layer arrangement and composition:

| | | |
|---|---|---|
| Overcoat Layer | Gelatin | 1.35 g/m$^2$ |
| | Dye I* | 0.48 g/m$^2$ |
| | Dye II** | 0.16 g/m$^2$ |
| Emulsion Layer | AgBr Emulsion (tabular grains 2.0 μm by 0.13 μm) | 7.56 g Ag/m$^2$ |
| | Gelatin | 4.92 g/m$^2$ |
| | Dye I* | 0.16 g/m$^2$ |
| | Dye II** | 0.11 g/m$^2$ |
| | 6-chloro-4-nitrobenzotriazole | 2.1 mg/m$^2$ |
| Support | Polyethylene terephthalate | |
| Emulsion Layer | AgBr Emulsion (tabular grains 1.3 μm by 0.13 μm, average) | 7.56 g Ag/m$^2$ |
| | Gelatin | 4.92 g/m$^2$ |
| | Dye I* | 0.16 g/m$^2$ |
| | Dye II** | 0.11 g/m$^2$ |
| | 6-chloro-4-nitrobenzotriazole | 2.1 mg/m$^2$ |
| Overcoat Layer | Gelatin | 1.35 g/m$^2$ |
| | Dye I* | 0.48 g/m$^2$ |
| | Dye II** | 0.16 g/m$^2$ |

Dye I* is bis[1-(4-carboxyphenyl)-3-methyl-2-pyrazolin-5-one-4] monomethineoxonol.
Dye II** is 4-(4-dimethylaminobenzylidene)-1-(4-carboxyphenyl)-3-methyl-2-pyrazolin-5-one.

EXAMPLES 1–2

Stability Studies of Various Developing Compositions

Black-and-white developing compositions having various amounts of hydroquinone, sulfite ions and borate ions were prepared and evaluated for solution stability. The compositions shown in TABLES III and IV below were subjected to accelerated aeration over a 10-day period by bubbling air (room temperature) through the tested solution (1 liter) at a rate of approximately 325 ml/min. TABLE IV shows the results in loss in hydroquinone and co-developing agent activity.

TABLE III

| COMPONENT | CONCENTRATION |
|---|---|
| Potassium sulfite | Various (mol/l) |
| 4-Hydroxymethyl-4-methyl-1-phenyl-3-pyrazolidone (co-developing agent, HMMP) | 4.9 mmol/l |
| Hydroquinone (HQ) | 0.36 mol/l |
| 5-Methylbenzotriazole | 0.45 mmol/l |
| Potassium hydroxide | 0.7 mol/l |
| Borate ions | Various (mol/l) |
| pH | Various (10.5–12.5) |

TABLE IV

| Composition | Borate ions | Sulfite ions | Sulfite:borate molar ratio | Sulfite:HQ molar ratio | % Loss in HQ* | % HMMP** |
|---|---|---|---|---|---|---|
| Control A | 0.017 | 0.53 | 31:1 | 1.47:1 | 9.0 | 68.5 |
| Control B | 0.017 | 0.60 | 35:1 | 1.68:1 | 7.7 | 98 |
| Control C | 0.017 | 0.66 | 39:1 | 1.83:1 | 7.6 | 100 |
| Control D | 0.043 | 0.53 | 12:1 | 1.47:1 | 8.4 | 81 |
| Control E | 0.051 | 0.53 | 10:1 | 1.47:1 | 8.9 | 71 |
| Example 1 | 0.043 | 0.60 | 14:1 | 1.68:1 | 6.3 | 96.5 |
| Example 2 | 0.043 | 0.66 | 15:1 | 1.83:1 | 6.8 | 100 |
| Control F | 0 | 0.53 | — | 1.47:1 | 9.3 | 65 |
| Control G | 0.017 | 0 | — | — | 19.2 | 0 |

*% HQ Loss was average loss of hydroquinone by percent per day.
**% HMMP was the amount of HMMP remaining after 10 days.

The results in TABLE IV indicate that the loss in HMMP became significant only after a significant portion of hydroquinone was oxidized (Controls A and F, and Controls D and E). The addition of more sulfite ions did reduce the rate of hydroquinone loss (Controls B and C). However, the addition of more borate ions did not significantly reduce the rate of hydroquinone loss (Controls D and E). These compositions were only slightly improved over Controls A and F. Developing composition G provided very poor protection from oxidation of both hydroquinone and co-developing agent.

In contrast, the addition of more borate ions in combination with the addition of sulfite ions reduced the hydroquinone loss (Examples 1 and 2). Example 2, with increased sulfite ions, was not significantly better in stability than Example 1.

The following TABLE V lists several commercially available black-and-white developing compositions (from Eastman Kodak Company) and certain features of their compositions. It is clear that all of them are outside the scope of the present invention.

TABLE V

| COMPOSITION | Borate ions (mol/l) | HQ (mol/l) | Sulfite ions (mol/l) | Sulfite/borate molar ratio | Sulfite:HQ molar ratio |
|---|---|---|---|---|---|
| RP X-OMAT Developer | 0.004 | 0.20 | 0.47 | 118:1 | 2.35:1 |
| RP X-OMAT Developer | 0.004 | 0.20 | 0.42 | 105:1 | 2.10:1 |
| RP X-OMAT Developer EX | 0.004 | 0.26 | 0.39 | 98:1 | 1.50:1 |
| X-OMAT RA/30 Developer | 0 | 0.29 | 0.60 | — | 2.07:1 |
| X-OMAT D3 Developer | 0 | 0.27 | 0.73 | — | 2.7:1 |
| X-OMAT RPJ Developer | 0 | 0.23 | 0.46 | — | 2.0:1 |
| GBX Developer | 0.0045 | 0.145 | 0.29 | 64:1 | 2.0:1 |
| READYMATIC Developer | 0.017 | 0.18 | 0.41 | 24:1 | 2.27:1 |
| Rapid Access Developer | 0.017 | 0.36 | 0.53 | 31:1 | 1.47:1 |
| CINEFLURE Developer | 0.025 | 0.104 | 0.47 | 19:1 | 4.5:1 |
| CINEFLURE HS Developer | 0 | 0.13 | 0.31 | — | 2.4:1 |
| INDUSTREX Developer | 0.0041 | 0.18 | 0.47 | 115:1 | 2.61:1 |
| Microfilm Developer | 0.0039 | 0.24 | 0.24 | 62:1 | 1:1 |

EXAMPLE 3

Discoloration Evaluations

Several black-and-white developing compositions were evaluated for discoloration by measuring their absorbance at 450 nm at certain times during aeration tests (described above). FIG. 1 shows the results, wherein Curve A represents the results for the Example 1 composition, Curve B represents the results for the Example 2 composition, Curve C represents the results for the Control A, Curve D represents the results for the Control B composition, and Curve E represents the results for the Control C composition.

It is clear from these data that compositions within the present invention are less discolored over time than the compositions outside the scope of this invention. The reduced discoloration is another indication of improved stability of the compositions of this invention.

EXAMPLE 4

Processing Radiographic Film

Samples of the radiographic film described above were exposed to roomlight (500 Lux fluorescent lighting) or safelight for 60 seconds, and hand processed using the developing composition of Example 1 at room temperature and in roomlight with limited agitation. Development was carried out with for 15 seconds. Fixing was then carried out for 15 seconds using a fixing composition (pH 5.2) comprising sodium thiosulfate (0.75 mol/l), sodium thiocyanate (3.9 mol/l), and sodium sulfite (0.1 mol/l).

After washing for about 15 seconds, the desired black-and-white images were obtained.

The invention has been described in detail with particular reference to preferred embodiments thereof, but it will be understood that variations and modifications can be effected within the spirit and scope of the invention.

We claim:

1. A method for providing a black-and-white image comprising:

A) processing an imagewise exposed black-and-white photographic silver halide element with an aqueous black-and-white developing composition in a processing container, said developing composition having a pH of from about 9 to about 12.5, and comprising:

at least 0.05 mol/l of a black-and-white hydroquinone developing agent, at least 0.05 mol/l of sulfite ions, and at least 0.004 mol/l of a borate buffering agent, wherein the molar ratio of sulfite ions to borate ions is from about 10:1 to about 20:1, and the molar ratio of sulfite ions to said hydroquinone developing agent is from about 1.6:1 to about 2.5:1, and B) at least one additional photographic processing step, said element comprising a support having thereon one or more layers, at least one of said layers being a silver halide emulsion layer.

2. The method of claim 1 wherein said element further comprises:

in one of said layers, a microcrystalline particulate dye that absorbs electromagnetic radiation in the visible and UV portions of the spectrum and is decolorized during fixing, and in each silver halide emulsion layer, a desensitizer that reduces sensitivity of the silver halide emulsion layer to electromagnetic radiation in the visible portion of the spectrum by trapping electrons generated by exposure to that electromagnetic radiation.

3. The method of claim 2 wherein said photographic element is a radiographic element having a film support and a silver halide emulsion layer on both sides of said support, said particulate dye is a polymethine dye present in said element in an amount of from about 0.5 to about 2 g/m$^2$, and said desensitizer is an azomethine dye present in said element in an amount of from about 1.5 to about 4 mg/m$^2$.

4. The method of claim 1 wherein said element comprises on each side of said support, a forehardened silver halide emulsion layer comprising at least 50% silver halide tabular grains having an aspect ratio of at least 2, and comprising at least 85 mol % bromide based on total silver.

5. The method of claim 1 that is carried out within about 50 seconds.

6. The method of claim 1 wherein step A is carried out within 30 seconds.

7. The method of claim 1 wherein said element further comprises an overcoat layer on both sides of said support, and said particulate dye is located in at least one of said overcoat layers.

8. The method of claim 1 wherein said additional processing step is a fixing step carried out using a fixing composition comprising from about 1.5 to about 6 mol/l of a fixing agent that is a thiosulfate, thiocyanate, or a mixture thereof.

9. The method of claim 1 wherein said photographic silver halide element has a silver coverage of at least 5 g/m$^2$.

10. The method of claim 9 wherein said photographic silver halide element is a radiographic film having a silver halide emulsion layer on both sides of said support, and the silver coverage in each of said sides is at least 2.5 g/m$^2$.

11. A black-and-white developing composition comprising:

at least 0.05 mol/l of a black-and-white hydroquinone developing agent, at least 0.05 mol/l of sulfite ions, and at least 0.004 mol/l of a borate buffering agent, wherein the molar ratio of sulfite ions to borate ions is from about 10:1 to about 20:1, and the molar ratio of sulfite ions to said hydroquinone developing agent is from about 1.6:1 to about 2.5:1.

12. The composition of claim 1 that is in aqueous form, and has a pH of from about 9 to about 12.5.

13. The composition of claim 1 comprising from about 0.1 to about 0.5 mol/l of said black-and-white developing agent, and from about 0.05 to about 3 mol/l of sulfite ions.

14. The composition of claim 13 comprising from about 0.15 to about 0.4 mol/l of said black-and-white developing agent, and from about 0.2 to about 1.25 mol/l of sulfite ions.

15. The composition of claim 1 wherein the molar ratio of sulfite ions to borate ions is from about 10:1 to about 15:1.

16. The composition of claim 1 wherein the molar ratio of sulfite ions to said hydroquinone developing agent is from about 1.6:1 to about 2:1.

17. The composition of claim 1 further comprising from about 3 to about 150 mol/l of a co-developing agent, and from about 0.01 to about 10 mmol/l of an antifoggant.

18. The composition of claim 17 further comprising from about 4 to about 50 mmol/l of a co-developing agent, and from about 0.1 to about 2 mmol/l of an antifoggant.

19. A photographic processing kit comprising:

a) a black-and-white developing composition comprising:

at least 0.05 mol/l of a black-and-white hydroquinone developing agent, at least 0.05 mol/l of sulfite ions, and at least 0.004 mol/l of a borate buffering agent, wherein the molar ratio of sulfite ions to borate ions is from about 10:1 to about 20:1, and the molar ratio of sulfite ions to said hydroquinone developing agent is from about 1.6:1 to about 2.5:1, and b) one or more of the following components:

a photographic fixing composition, a black-and-white photographic silver halide element, and a processing container.

* * * * *